US005205271A

United States Patent [19]

Casas Salva

[11] Patent Number: 5,205,271

[45] Date of Patent: Apr. 27, 1993

[54] AIR RIFLES OF THE HINGED BARREL TYPE

[75] Inventor: Francisco Casas Salva, San Baudilio de Llobregat, Spain

[73] Assignee: Industrias El Gamo, S.A., Sant Boi de Llobregat, Spain

[21] Appl. No.: 732,208

[22] Filed: Jul. 19, 1991

[30] Foreign Application Priority Data

Jul. 20, 1990 [FR] France ..... 90 09538

[51] Int. Cl.[5] ..... F41B 11/18; F41B 11/14

[52] U.S. Cl. ..... 124/66; 124/65

[58] Field of Search ..... 124/63-67; 285/118, 283

[56] References Cited

U.S. PATENT DOCUMENTS

| | | | |
|---|---|---|---|
| 440,381 | 11/1890 | Vaughan | 124/67 |
| 1,250,304 | 12/1917 | Greenleaf et al. | 124/67 |
| 1,448,646 | 3/1923 | Ward | 285/283 |
| 4,367,723 | 1/1983 | Resuggan | 124/67 |
| 4,883,042 | 11/1989 | Wackrow | 124/67 |

FOREIGN PATENT DOCUMENTS

| | | | |
|---|---|---|---|
| 132086 | 7/1902 | Fed. Rep. of Germany | 124/66 |
| 574329 | 4/1933 | Fed. Rep. of Germany | 124/67 |
| 714832 | 12/1941 | Fed. Rep. of Germany | 124/67 |
| 1913239 | 10/1969 | Fed. Rep. of Germany . | |
| 12763 | of 1896 | United Kingdom | 124/67 |
| 941711 | 11/1963 | United Kingdom | 124/67 |

*Primary Examiner*—Randolph A. Reese
*Assistant Examiner*—John A. Ricci
*Attorney, Agent, or Firm*—Jacobson, Price, Holman & Stern

[57] ABSTRACT

An air rifle of the hinged barrel type has an injection molded single piece fork member (7) connected for articulation with the barrel (1), the fork member having a cylinder portion (8) extending therefrom that is secured in the compression chamber (3) integral with the buttstock. The barrel casing has a widened portion (4) located at the rear end of the barrel and includes an articulation pin (5) pivotally connected with the fork member (7), a resilient catch (6) within a recess (14) and a locking point (12) of the compressed air piston (27) driving lever (13).

6 Claims, 3 Drawing Sheets

AIR RIFLES OF THE HINGED BARREL TYPE

BACKGROUND OF THE INVENTION

This invention relates to improvements in air rifles of the hinged barrel type in which the rear end of the barrel is hinged to the front end of the body of the rifle, so that it can be swung out of its normal or firing position to enable a pellet to be inserted into its rear end and so that it can be used as a lever for compressing a spring within the body of the rifle.

In prior hinged barrel type rifle designs wherein a fork-shaped part secures the hinged connection between the barrel casing and the compression chamber body it is known:

a) to construct the assembly of the fork member and compression chamber with only a single body obtained by a forging operation as described in German Patent No. De-A- 1,913,239. The purpose of this prior device is to obtain transfer passage of a small length communicating the compression chamber with the base of the fork member to increase the performance of the rifle by a lesser pressure loss; the technique implies the following drawbacks:

very expensive fabrication costs;

compelled finishing operations;

necessitates special reinforcement means in the used pistons due to the specific shape of the compression chamber obtained by forge;

b) to provide a thread connection that needs the thread cut in a cylindrical part, extending the fork, that is set on the compression chamber front end entrance, provided, on its inner wall, with a second thread cut; this solution presents the drawback of a requirement for a greatly accurate function associated with the fact that the assembly between the two parts must be vacuum-tight because any pressure decrease in the chamber generates a significant decrease in the rifle performance;

c) to provide a welded connection of the cylindrical portion, extending from the fork, that remains introduced in the entrance of the compression chamber front end, using mainly manufacturing process.

The requirements of the fork-shaped piece are to secure the vacuum-tight connection of the compression chamber end, and to allow the axis of the barrel, in firing position of the arm, to be coaxially aligned with the compression chamber air exit hole.

For this purpose several means are used:

a) devices working as a positioning stop, in firing position of the arm, comprising a locking element, obtained by an accurate finish of the surfaces in contact, in such a way that the fork bottom and the barrel casing rear face on which the part is hinged, are substantially flat:

b) devices using stops defined between a step of the casing of the barrel rear end and a second step formed by a prismatic section that constitutes a portion of the stop part for the locking element, set at the fork bottom; the faces in contact of the two stepped profiles require an accurate finish; in addition, the relative position of the two steps require very accurate calculations to guarantee, in firing position of the arm, the coaxial alignment of the pressurized air exit hole with the barrel axis requiring also further control and testing works for each part entering in the manufacturing process;

c) barrel stops constituted by a groove made on the barrel lower portion that corresponds at least with a fork cross rod, such as disclosed in the British Patent GB 941 711;

d) positioning stops constituted by a fractioncylindrical configuration that extends in the barrel casing rear portion and that is supported on a cylindrical portion located at the compression chamber front end.

All these solutions, though valid, require, in general, for their embodiment, delicate mounting operations and further very accurate finish and testing works to guarantee a perfect alignment between the barrel and the compressed air exit hole, essential works for a suitable efficiency of the rifle and making in addition possible the effectiveness of connections means set by a profile in correspondence between the fork member and the barrel rear end, making the joining area vacuum-tight, co-operating also with the pressurized air optimum efficiency.

BRIEF SUMMARY OF THE INVENTION

The object of this invention consists in overcoming the above drawbacks by means of several features of the components providing a significant production costs saving and maintaining the rifle performances. A further objection of the invention consists in a particular embodiment of the fork-shaped piece, hinged on the barrel, and its locking on the compression chamber end, as well as the features of the casing of the barrel, determining essentially a significant saving in the embodiment cost of each part, without weakening the operational and accuracy features of the parts involved by the improvements.

The invention provides an embodiment of the fork-shaped member that ends the compressed air chamber and that comprises a hole coaxially aligned with the barrel axis, in firing position of the arm to obtain a single body obtained by means of a molding operation by injecting a suitable material, advantageously a high resistance and mechanical performance plastic material, able to sustain impact and rub and shearing stresses, with a cylindrical rear portion ready to be adjustably inserted in the front entrance of the compression chamber, including vacuum-tight means inserted between related profile and locked by simple cross pins, simplifying significantly the manufacturing process that allows a saving on each assembly manufactured. The rear end of the barrel has a widened casing that includes a cross pin and a resilient catch respectively designed to its articulation and its locking on a fork member that is extended by a cylindrical portion made integral with the compression chamber mounted on the buttstock of the rifle, the cylindrical portion bearing an axial transfer passage through which air can pass to the barrel when the rifle is fired.

In addition the enveloping part of the barrel rear portion, widened and provided with opening passages for the swinging articulation, locking holes of the lever loading the spring, a recess to mount the locking element of the two parts of the rifle, in firing position, and the rising support, designed to be hinged connected to the fork, is also obtained by a molding operation by injection of the material, namely plastic material as above, that embody at the same time the barrel complete casing, with a hole at its front end for the projectile exit and with the barrel rear portion slightly projecting from the casing.

The positioning means between the rear end of the barrel casing and the fork, in firing position are achieved according to the invention, by means of a stop configuration defined by a half-cylindrical profile on the fork bottom, coaxial with the axial transfer passage axis of the cylindrical portion communicating the compression chamber with the bottom of the stop configuration supporting in the firing position, the barrel slightly protruding end pertaining to its casing rear portion. This implies, bearing in mind the embodiment by molding by injection of the fork member and the barrel casing body, that as much the fork as the casing dimensions, in hinged correspondence and the distances between the half-cylindrical profile and the articulation axis, are permanently guaranteed and with this the coaxial alignment in firing position, without any further requirement but those foreseen when making the mold.

The above and other objects, advantages and features of the present invention will become more apparent from the following description of a preferred embodiment thereof.

BRIEF DESCRIPTION OF THE DRAWINGS

The invention will now be described in detail with reference to the accompanying drawings wherein.

DETAILED DESCRIPTION

Figure 1:
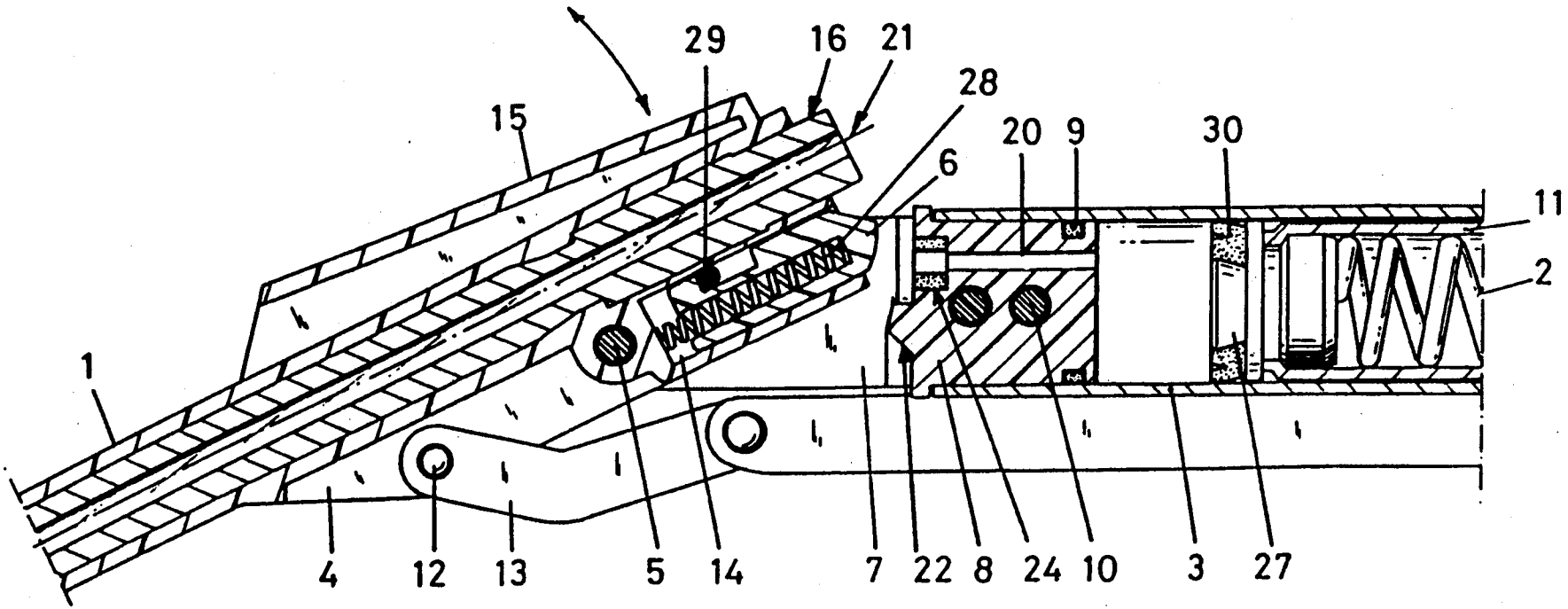
FIG. 1 is a longitudinal cross-sectional view of the hinge part of an air rifle in accordance with the invention, in open rifle position.
Figure 2:
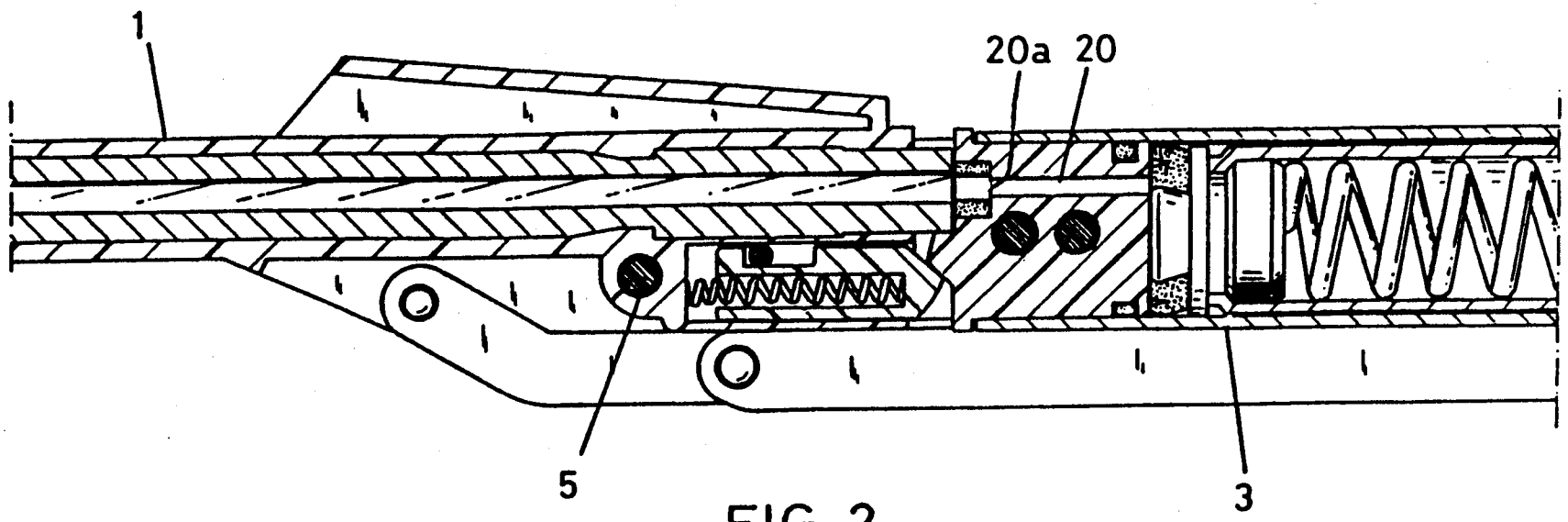
FIG. 2 is a view similar to FIG. 1 in firing position.
Figure 3:
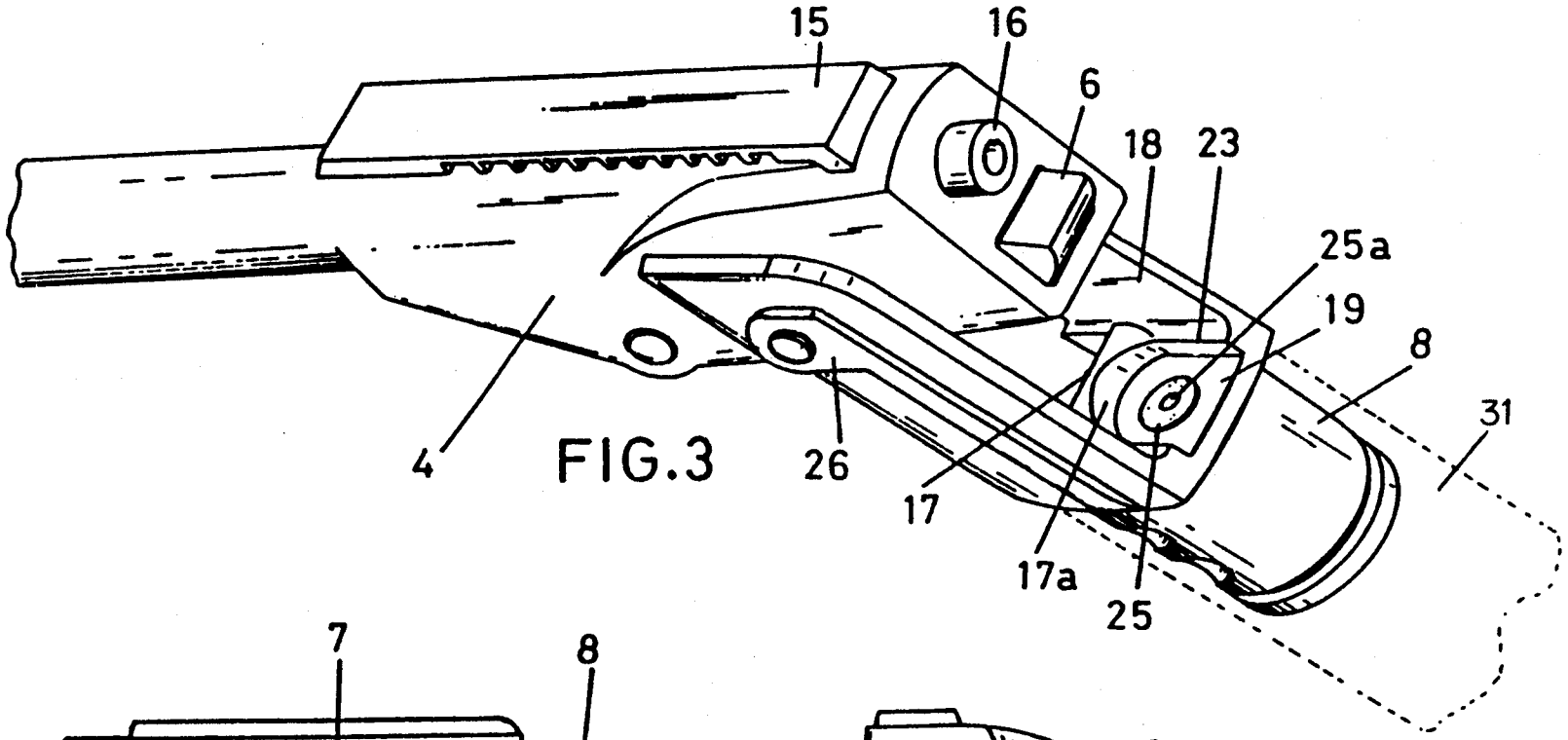
FIG. 3 is a perspective view of the parts in of the invention.
Figure 4:
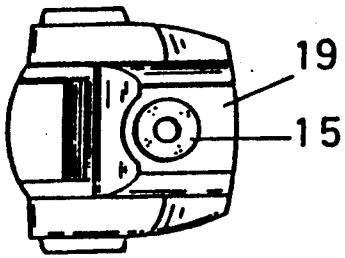
FIGS. 4 and 5 are respectively detailed views of the bottom plane of the fork and of the single body including the fork and the cylindrical extension thereof.
Figure 5:
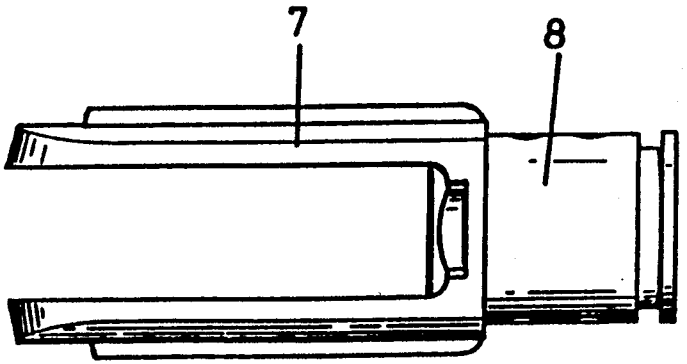

The rifle represented in the figures is made up of tiltable barrel 1 serving as a lever to a hinged levers mechanism 13 designed to compress the spring 2 associated with the piston 27 in a compression chamber 3, the barrel comprising at its rear end a widened casing 4 that includes a cross pin 5 and a catch 6 respectively designed for articulation and locking on a fork 7 ending in a cylindrical portion 8 made integral with the compression chamber mounted on the buttstock 31. The fork and its cylindrical extension are constituted by a single body obtained by means of an injection molding operation of a suitable material, namely plastic material of high resistance and mechanical performance. The single body is connected to the compression chamber front end, by adjusted insertion of its cylindrical portion, with a previous assembly of coaxial vacuum-tight seal 9, namely of the O-ring type, both parts being tightly locked by means of cross pins 10 that cross the fork extension cylindrical portion and the compression chamber wall.

The barrel rear portion casing 4, widened, has opening passages designed for its articulation cross pin 5 with the fork and the locking 12 of the compression lever 13 of the chamber compression spring 2, a recess 14 for mounting a locking element, namely a catch 6, of the rifle in firing position. A rising support 15 is also obtained by means of a molding operation by injection that allows obtaining the complete casing of the barrel with a hole at its front end for the projectile exit and portion 16 of the barrel, protruding from the rear portion of the casing, for the purpose of adjusting itself on the existing configuration 17 on the fork bottom, designed for proper centering.

The connection of casing part 4 of the barrel rear portion to the compression chamber 3 is formed of a single body with a mass section 8 advantageously cylindrical, of a diametrical dimension suitable to allow its connection with the chamber by an adjusted insertion at the front end thereof, that is extending in a fork member 7 made up of two parallel limbs 18, substantially symmetrical, having flat inner faces. An intermediate branch or part 19 also internally flat presents a wall 17 located below an axial transfer passage 20 extending through the cylindrical portion 8, that communicates with the pressure chamber, bearing the wall, on the side nearer to the duct. A rabbet 17*a* of half cylindrical shape, is centered with respect to the duct, to serve as a support for the barrel 16 rear protruding section, and for axially centering the axis 21 of the barrel body in line with the compressed air exit hole 20*a* of the compression chamber. On the opposite side of the wall an inclined plane 22 is situated in front of the locking element in the rifle firing position, the wall being delimited by two rectilinear side profiles 23 that secure the stepped connection with the flat face and provide the barrel centering and reinforcement functions.

The axial transfer passage 20 through the cylindrical portion 8 of the fork-shaped single body, emerges at a cylindrical recess 24 located at the bottom of the fork 7, housing a joint 25, also cylindrical and forming a central recess as an extension of the axial duct communicating with the compression chamber, joint 25 slightly protruding with respect to the fork bottom plane and having a central duct 25*a*.

The external surface of the fork parallel limbs, have reinforcement ribs 26 extending lengthwise on an area that surrounds the opening passages through which is hinged the barrel 1 by means of a pivot pin 5.

The assembly shown further comprises:

the spring 28 of the catch 6 and a bolt 29 that limit its run;

a vacuum-tight joint 30 at the piston end 27;

the piston rod body 11.

I claim:

1. An air rifle of the hinged barrel type having a tiltable barrel with a bore pivotly connected to a buttstock, comprising:

a compression chamber within said buttstock;

a compression spring disposed within said compression chamber;

a first sub-assembly at the rear end portion of said barrel adjacent said buttstock comprising a casing substantially enclosing the rear end portion of said barrel with a part of said barrel extending rearwardly from said casing, and a releasable locking means on said casing;

a second sub-assembly comprising an injection molded plastic forked member having a cylindrical portion inserted within said compression chamber, a circumferential groove on said cylindrical portion, an O-ring seal in said circumferential groove to provide an airtight seal between said cylindrical portion and said compression chamber, at least two transverse open passages through said cylindrical member, locking pins in said transverse open passages and engaging said buttstock for securing said cylindrical portion in said compression chamber, two parallel fork limbs receiving therebetween a part of said first sub-assembly, a fork bottom between said parallel fork limbs, an intermediate part on said fork bottom having a flat transverse wall, an axial transfer passage extending through said cylindrical portion and through said transverse wall communicating said compression chamber with the bore of said barrel when said barrel is in a closed firing position for use, a semi-cylindrical shaped rabbet on said transverse wall and centered coaxially with said axial transfer passage for supporting said rearwardly extending part of said rear end of said barrel when in firing position and coaxially centering said bore of said barrel with said axial transfer passage, an inclined plane on said transverse wall engagable with said locking means on said first sub-assembly when in firing position for retaining said bore of said barrel in alignment with said axial transfer passage, and two-side rectilinear profiles on said forked member delimiting said transverse wall and engaging said rearwardly extending part of said rear end of said barrel for reinforcing and centering said barrel with the bore thereof aligned with said axial transfer passage in firing position;

aligned transverse passages through said fork limbs and said first sub-assembly casing;

a hinge pin extending through said aligned passages for pivotly connecting said sub-assemblies together; and a lever mechanism pivotly connecting said buttstock with said first sub-assembly casing for compressing said spring within said compression chamber when said sub-assemblies are aligned in the firing position.

2. The air rifle as claimed in claim 1 wherein:

said casing of said first sub-assembly comprises an injection molded plastic member; and said releasably locking means in said casing comprises a recess in said casing, and a resilient catch slidably mounted in said recess and resiliently urged rearwardly towards said buttstock.

3. The air rifle as claimed in claim 2 and further comprising:

a cylindrical recess in said cylindrical portion of said second sub-assembly at the end of said axial transfer passage at said transverse wall; and a cylindrical joint member in said cylindrical recess having a central passage therein aligned with said axial transfer passage for communication with said compression chamber, said joint member protruding slightly from said transverse wall.

4. The air rifle as claimed in claim 3 and further comprising:

a reinforcement rib on each of said fork limbs extending lengthwise on the outer surface thereof opposite to the surface adjacent said first sub-assembly casing and having a front portion thereof surrounding said respective hinge pin hole; and a further hole in each front portion for receiving said hinge pin.

5. The air rifle as claimed in claim 1 and further comprising:

a cylindrical recess in said cylindrical portion of said second sub-assembly at the end of said axial transfer passage at said transverse wall; and a cylindrical joint member in said cylindrical recess having a central passage therein aligned with said axial transfer passage for communication with said compression chamber, said joint member protruding slightly from said transverse wall.

6. The air rifle as claimed in claim 1 and further comprising:

a reinforcement rib on each of said fork limbs extending lengthwise on the outer surface thereof opposite to the surface adjacent said first sub-assembly casing and having a front portion thereof surrounding said respective hinge pin hole; and a further hole in each front portion for receiving said hinge pin.

* * * * *